US009282843B1

(12) United States Patent
Al-Anzi

(10) Patent No.: US 9,282,843 B1
(45) Date of Patent: Mar. 15, 2016

(54) PORTABLE EXPANDING BARRIER FOR MUSLIM WORSHIPPERS

(71) Applicant: Bader Shafaqa Al-Anzi, Abdullah Al-Mubarak (KW)

(72) Inventor: Bader Shafaqa Al-Anzi, Abdullah Al-Mubarak (KW)

( * ) Notice: Subject to any disclaimer, the term of this patent is extended or adjusted under 35 U.S.C. 154(b) by 0 days.

(21) Appl. No.: 14/789,977

(22) Filed: Jul. 1, 2015

(51) Int. Cl.
*A47G 33/02* (2006.01)
*A47G 33/00* (2006.01)
*A47G 27/00* (2006.01)

(52) U.S. Cl.
CPC ..... *A47G 33/02* (2013.01); *A47G 33/00* (2013.01); *A47G 27/00* (2013.01)

(58) Field of Classification Search
CPC ..... A47G 27/00; A47G 33/00; A47G 33/02
USPC ..... 434/245
See application file for complete search history.

(56) References Cited

U.S. PATENT DOCUMENTS

| | | | | |
|---|---|---|---|---|
| 846,552 | A * | 3/1907 | Collins | A63B 55/50 248/166 |
| 4,197,807 | A * | 4/1980 | Campbell | E01G 9/0122 116/63 P |
| 4,979,531 | A * | 12/1990 | Toor | E04H 15/60 135/114 |
| 7,600,554 | B1 | 10/2009 | Wright et al. | |
| 2010/0044661 | A1 | 2/2010 | Weiner | |
| 2014/0039675 | A1 | 2/2014 | Ead | |
| 2015/0013737 | A1 | 1/2015 | Daly | |

FOREIGN PATENT DOCUMENTS

| | | | | |
|---|---|---|---|---|
| EP | 0004996 | | 10/1979 | |
| EP | 0004996 | A1 * | 10/1979 | A47G 33/008 |
| FR | 2999402 | | 6/2014 | |
| WO | WO 2009/082992 | | 7/2009 | |

OTHER PUBLICATIONS

"MVI 0201," Arif Vohra, Salah Sutrah, https://www.youtube.com/watch?feature=player_embedded&v=IOizJM7yZEM, Jul. 14, 2011, via "Revive a Sunnah, Use a Sutrah," http://salahsutrah.com/Index.htm, Jul. 14, 2011.*

"Helix Document Tube, Expands from 28 to 49-Inches, Large," Helix, http://www.amazon.com/Helix-Document-Expands-49-Inches-61500/dp/B0056HRKDW/ref=cm_cr_pr_product_top?ie=UTF8, Jun. 1, 2011.*

* cited by examiner

*Primary Examiner* — Sam Yao
*Assistant Examiner* — Jennifer Fassett
(74) *Attorney, Agent, or Firm* — Richard C. Litman

(57) ABSTRACT

The portable expanding barrier, or "sutra," for Muslim worshippers provides protection for the area immediately in front of a worshipper of the Muslim faith during prayer. The barrier comprises several embodiments, including multiple short telescoping segments, coil springs encased in a flexible sleeve, multiple segments keyed together for locking into extended position by partial rotation, hollow tubular segments connected by an elastic cord extending through the segments, and multiple rigid segments pivotally secured to one another at alternate ends of each segment. The device may be integrated with a prayer rug, and mechanisms may be provided for automatic barrier deployment. A compass may be included.

11 Claims, 8 Drawing Sheets

PORTABLE EXPANDING BARRIER FOR MUSLIM WORSHIPPERS

BACKGROUND OF THE INVENTION

1. Field of the Invention

The present invention relates generally to articles and devices used in religious practices, and particularly to a portable expanding barrier known as a "sutra" or "sutrah" for use by worshippers of the Muslim faith. The barrier serves to protect a space or span directly in front of the worshipper as he or she faces Mecca (Makkah) and the Kaaba shrine during prayer.

2. Description of the Related Art

The Muslim faith requires that practitioners pray several times a day, and that they face toward the holy shrine (Kaaba) in Mecca (or Makkah) while praying. Muslims customarily use a prayer rug or mat, upon which they position themselves during prayer. It is also a tenet of Muslim religious law that a Muslim at prayer should not have his or her immediate path trespassed by another during prayer. This is taken to mean that another person should not step immediately in front of a Muslim at prayer, e.g., closer than about one yard or one meter and between the person at prayer and Mecca.

Accordingly, various means have been developed in the past to signify or to provide notice of this protected area. Such devices are known as "sutras" or "sutrahs." Historically, Muslims have simply placed a stick or similar article in the ground to designate the protected area. More recently, large wooden stands have been developed to serve this purpose, but they are invariably too large, bulky, and massive to be of practicable use for transport.

Various devices have been developed in the past for assisting the Muslim at prayer. An example of such is found in International Patent Publication No. 2009/082,992 published on Jul. 9, 2009 to Enerday GMBH. This reference describes (according to the drawings and English abstract) a relatively complex electronic device for indicating the direction of the Kaaba in Mecca, or Makkah. The device is securely anchored to the underlying surface for use, by a series of screw anchors.

French Patent Publication No. 2,999,402 published on Jun. 20, 2014 to Ayoub Belemlih describes (according to the drawings and English abstract) a prayer rug or mat having an integral compass for indicating the direction of Mecca (Makkah) for prayer. The rug is reinforced at points of likely highest wear.

Thus, a portable expanding barrier for Muslim worshippers solving the aforementioned problems is desired.

SUMMARY OF THE INVENTION

The portable expanding barrier or "sutra," or "sutrah," for Muslim worshippers is a relatively small and compact device that is easily carried for deployment and use during prayer. The device comprises a base with an extensible barrier or marker that is collapsed or retracted into the base for compact storage when not in use. The base may contain a compass or other directional indicator for the worshipper to align himself or herself in the direction of Mecca, or Makkah, during prayer. The device may include a mechanism for automatically deploying the barrier or sutra when activated by the worshipper, or when the base is placed upon an underlying surface. The device may be a stand-alone unit, or may be incorporated with a prayer rug or mat.

Numerous embodiments are described herein. One embodiment comprises a telescoping column of several segments to provide sufficient height when extended and to provide for compact storage when retracted. Another embodiment comprises a coil spring that is wrapped or encased in a sleeve of flexible material (fabric, plastic, etc.). Yet another embodiment comprises a series of interlocking rigid sleeves that may be locked in their extended state by rotating each segment through a partial turn relative to the adjoining segment. A further embodiment comprises a series of tubular sections with an elastic cord extending through all of the sections, to draw the sections into alignment with one another for erection of the barrier or marker. Still another embodiment comprises a series of rigid sections pivotally attached to one another at alternating ends of the segments.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The portable expanding barrier for Muslim worshippers serves as a device for protecting a space or area immediately in front of the Muslim worshipper at prayer as the worshipper faces in the direction of the Kaaba shrine in Mecca (Makkah). Trespass by others directly in front of the Muslim worshipper at prayer is believed to affect the prayer and thus the reward received from the prayer. As such, a barrier, or a "sutra" or "sutrah," used to prevent such trespass can be used. The sutrah is placed in front of the worshipper to serve as a barrier between the worshipper and those passing in areas in front of the worshipper.

Figure 1:
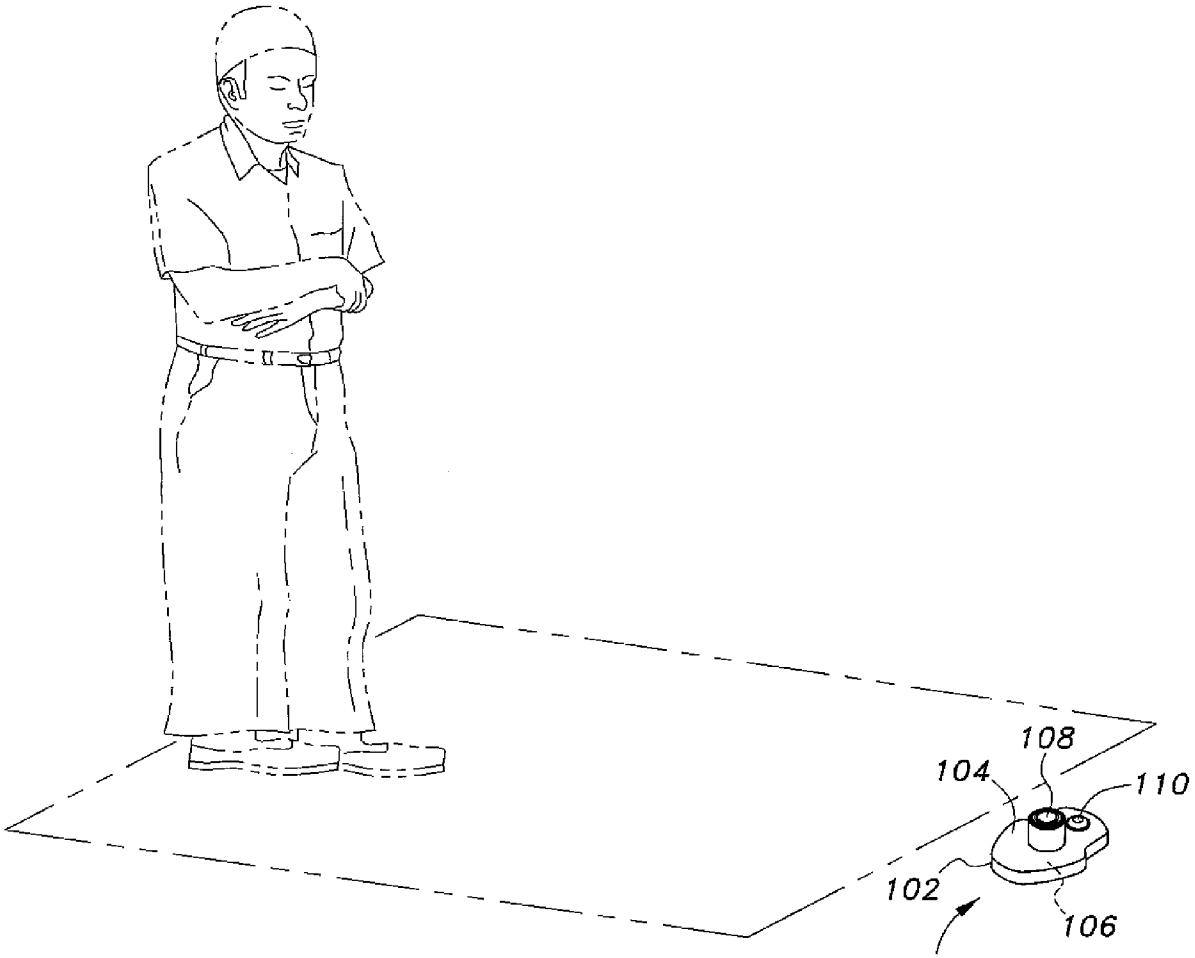
FIG. 1 is an environmental, perspective view of a first embodiment of the portable expanding barrier for Muslim worshippers according to the present invention, illustrating the device in a retracted state.

FIG. 1 provides an environmental perspective view of a first embodiment of the portable expanding barrier, or barrier, 100. The barrier 100 includes a relatively low, flat base 102 having an upper surface 104 and an opposite lower surface 106. A single barrier column 108 (shown in its retracted state in FIG. 1) selectively extends from the upper surface 104 of the base 102, and is generally normal to the plane of the base 102. In the embodiment of FIG. 1, the barrier column 108 comprises a plurality of mutually concentric and telescoping tubular segments or sections, with a largest diameter section attached directly to the base 102 with progressively smaller sections or segments contained therein and telescoping upward therefrom to extend the barrier column 108. When extended, the barrier column 108 can have a height of about 20 cm to about 25 cm. A compass 110, or other directional indicator, is installed in the upper surface 104 of the base 102 so as to be visible to the worshipper for proper orientation during prayer.

Figure 2:
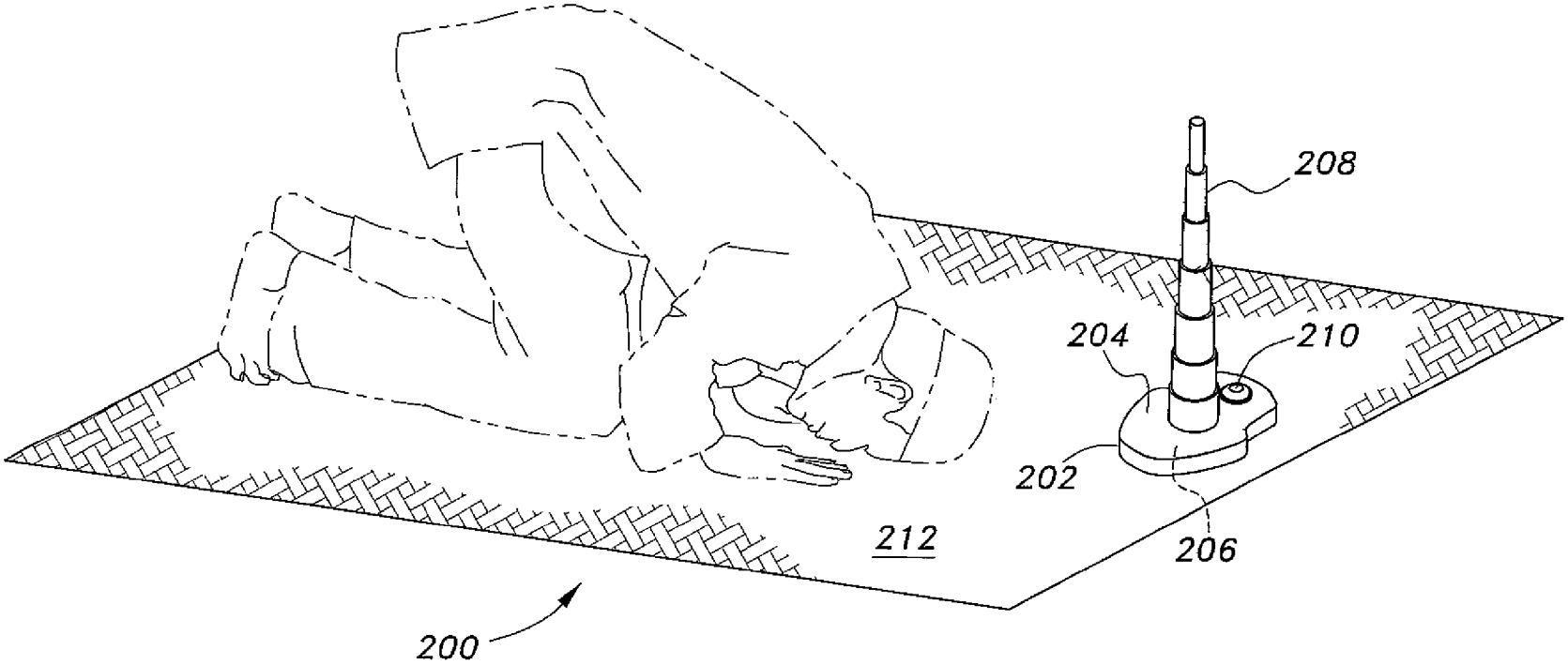
FIG. 2 is an environmental, perspective view of a second embodiment of the portable expanding barrier for Muslim worshippers according to the present invention, showing the device as an integral component with a prayer rug or mat and shown in an extended state.

FIG. 2 illustrates a second embodiment of the portable expanding barrier, designated as barrier 200. The low, flat base 202 with its upper surface 204, lower surface 206, telescoping barrier column 208 (shown extended in FIG. 2), and compass (or other directional indicator) 210 are identical or equivalent to those components 102 through 110 of the embodiment 100 of FIG. 1. However, in the embodiment 200 of FIG. 2, the lower surface 206 of the base 202 is permanently attached to the prayer rug or mat 212, with the prayer rug 212 extending from the base 202, rather than the barrier being a separate component from the rug as in the case of the barrier 100 embodiment of FIG. 1. The attachment means is conventional, e.g., adhesive, mechanical fasteners, etc. This facilitates the carriage of the barrier components 202 through 210, as they are a permanent component of the barrier and prayer rug assembly 200.

Figure 3:
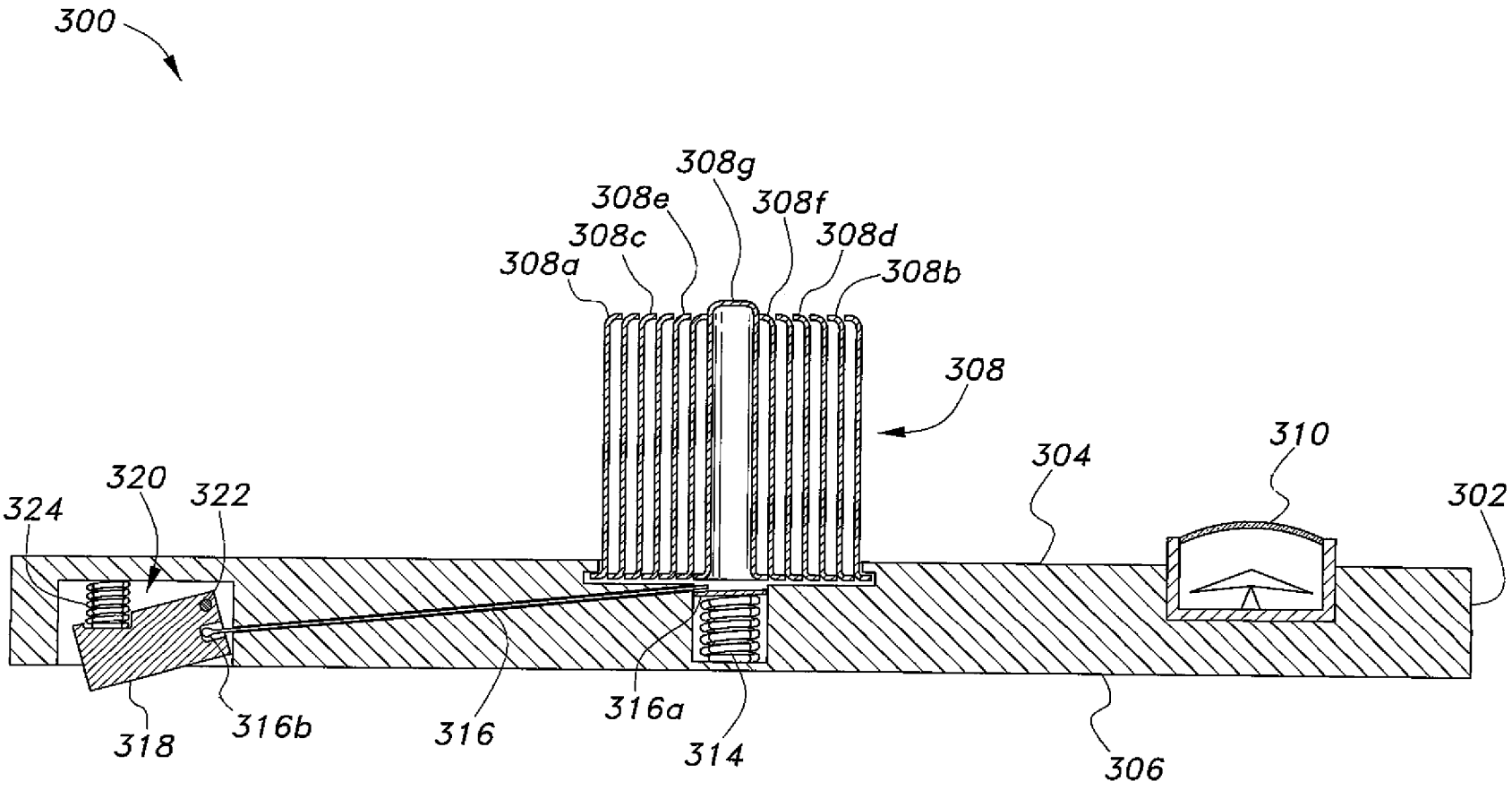
FIG. 3 is a side elevation view in section of a third embodiment of the portable expanding barrier for Muslim worshippers according to the present invention, showing details of the extension and retraction mechanism thereof.

FIG. 3 provides a side elevation view in section of a third embodiment portable expanding barrier 300. The barrier 300 is similar to the barrier 100 of FIG. 1, but incorporates a mechanism for automatically extending the barrier column 308 when the base 302 is placed upon an underlying surface. The low, flat base 302 includes an upper surface 304, an opposite lower surface 306, and a telescoping column 308 formed of progressively smaller diameter tubular segments 308*a* through 308*g*. (More or fewer segments may be provided.) This is essentially the same configuration as used in the telescoping columns 108 and 208, respectively of the embodiments 100 and 200 of FIGS. 1 and 2. A compass 310 is provided in the upper surface 304 of the base 302.

The automatic column extension mechanism of the portable expanding barrier 300 includes a compression spring 314 disposed in the base 302, beneath the telescoping column 308. A latch member 316 has an end 316*a* that extends over the upper edge of the spring 314 to hold the spring in compression and prevent the extension of the spring 314 and column 308. The latch member 316 comprises an elongate wire or similar member having a distal end 316*b* connected to a trigger 318 that is recessed in a receptacle 320 open to the lower surface 306 of the base 302. The trigger 318 pivots about a transverse pivot pin 322, with the opposite free end of the trigger being urged to protrude below the plane of the lower surface 306 of the base 302 by a spring 324.

When the base 302 is placed upon an underlying surface, the surface pushes the protruding free end of the trigger 318 up into its receptacle 320. This draws the end 316*b* of the latch member 316 to the left, as viewed in FIG. 3, thus also drawing the opposite end 316*a* of the latch member clear of the spring 314 to allow the spring 314 to extend the segments 308*b* (308*a* is fixed to the upper surface 304 of the base 302) through 308*h* to form the extended barrier column, as shown by the column 208 of the embodiment 200 of FIG. 2. The column 308 (and other similar columns of other embodiments) is easily compressed when storage is desired, allowing the end 316*a* of the latch member 316 to extend over the end of the compressed spring 314. It will be seen that this embodiment, and/or any of the other embodiments, may be combined with the prayer rug 212 of the embodiment 200 of FIG. 2, if so desired. A passage may be formed through the prayer rug to allow the trigger 318 to protrude through the prayer rug, thereby allowing the trigger to be depressed when the prayer rug and its portable expanding barrier are placed upon an underlying surface.

Figure 4:
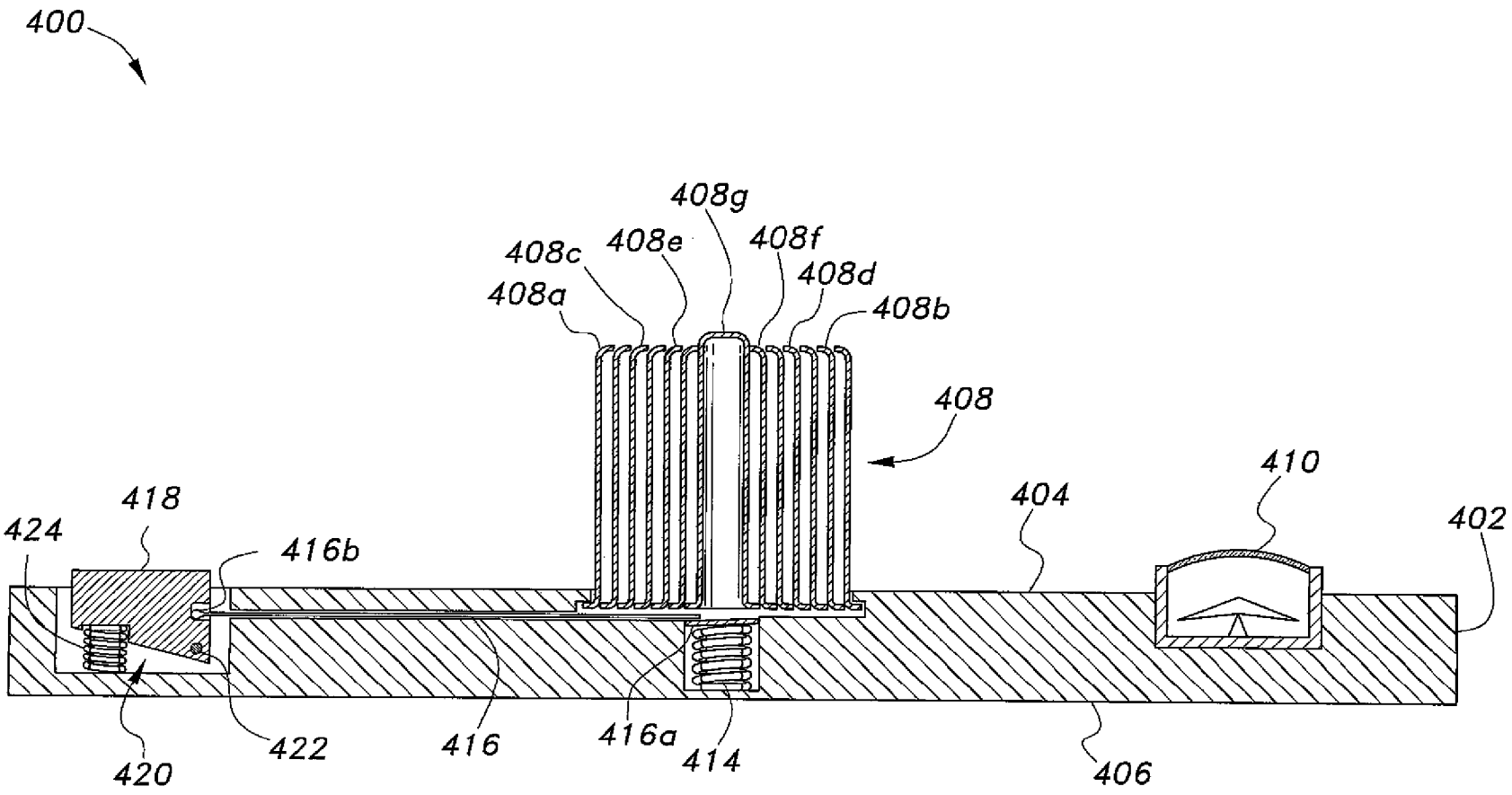
FIG. 4 is a side elevation view in section of the embodiment of FIG. 1 of the portable expanding barrier for Muslim worshippers according to the present invention, showing details of an alternative latching mechanism from that of the embodiment of FIG. 3.

The portable expanding barrier embodiment 400 of FIG. 4 is similar to the barrier embodiment 300 of FIG. 3, with the exception that the trigger 418 extends from the upper surface 404 of the base 402, rather than from the lower surface as in the embodiment 300 of FIG. 3. The barrier 400 of FIG. 4 includes a base 402 having an upper surface 404, opposite lower surface 406, telescoping column 408 formed of tubular segments 408*a* through 408*g* (more or fewer segments may be provided), and compass 410. The automatic extension mechanism comprises compression spring 414, latch member 416 with its two opposed ends 416*a* and 416*b*, trigger 418 disposed within a receptacle 420 in the base 402 and pivoting on a pivot pin 422. The spring 424 urges the free end of the trigger 418 outward from the receptacle 420. The difference between this embodiment 400 and the previous embodiment 300 of FIG. 3, is that the trigger receptacle 420 is open to the upper surface 404 of the base 402, rather than the lower surface. In the embodiment 400 of FIG. 4, the trigger 418 must be actuated by the person using the device, rather than the trigger being actuated by placing the device upon an underlying surface as in the embodiment 300 of FIG. 3. Nevertheless, the actuation of the trigger 418 still constitutes automatic extension of the telescoping barrier column 408, as opposed to the worshipper being required to extend each of the tubular column segments 408*b* through 408*g* manually.

Figure 5:
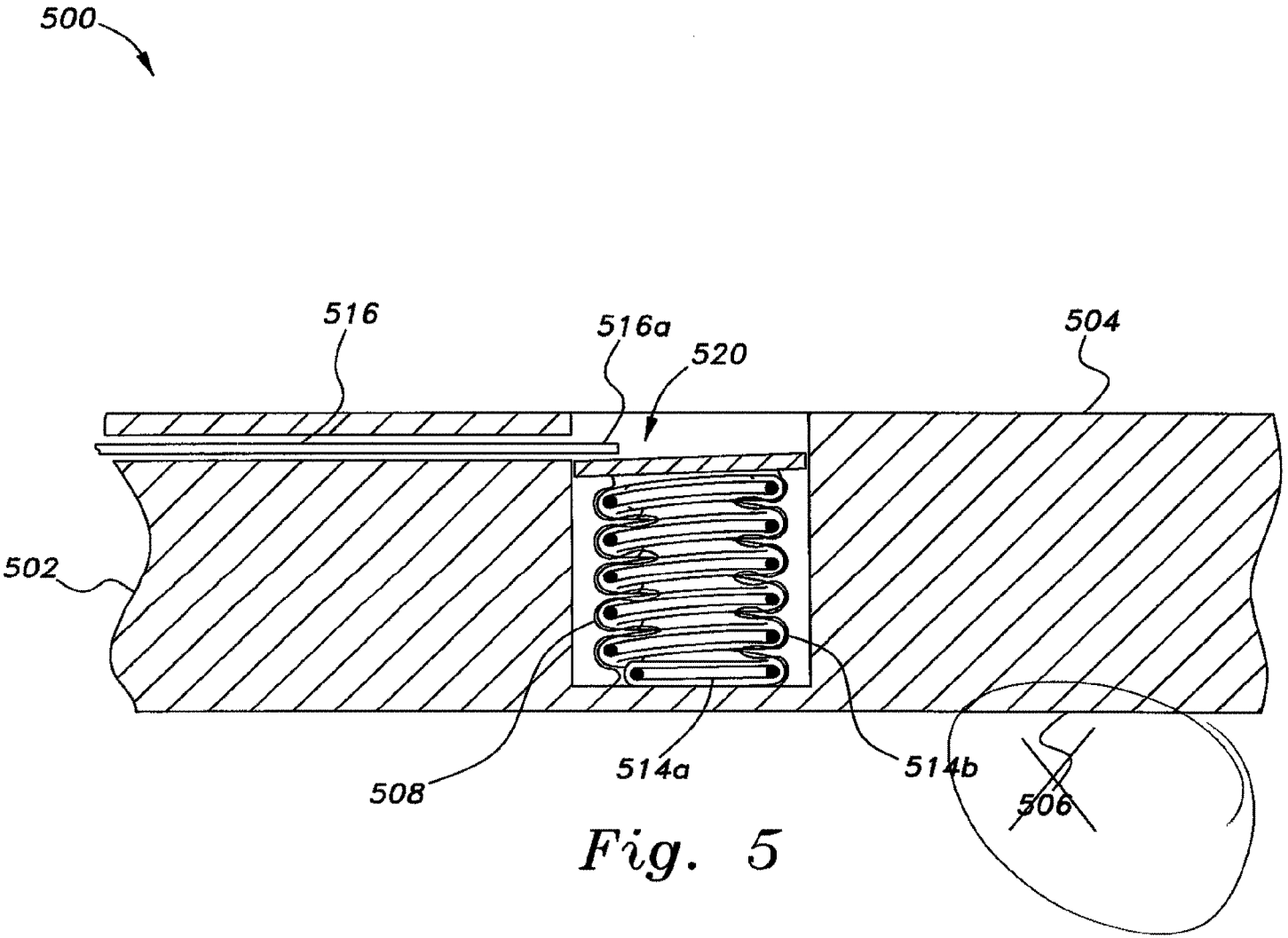
FIG. 5 is a detailed side elevation view in section of a fourth embodiment of the portable expanding barrier for Muslim worshippers according to the present invention, illustrating an alternative spring configuration.

FIG. 5 is a broken away detailed elevation view in section of a fifth embodiment of the portable expanding barrier, designated as barrier 500. Only a portion of the base 502 is illustrated in FIG. 5, to show the alternative barrier column configuration. In the embodiment of FIG. 5, the barrier column 508 comprises a compression spring 514*a* that is encased or enclosed in a flexible (e.g., fabric, plastic, etc.) sleeve 514*b*, with the column 508 being seated in a receptacle 520 open to the upper surface 504 of the base 502. Such spring and sleeve enclosures are known in the field of clothes dryer vents, flexible ducts, and the like, and may be compressed to the extent allowable by the spring, due to the flexibility of the sleeve. The release of the barrier column 508 by withdrawal of the end 516*a* of the latch member 516 allows the spring 514*a* and its sleeve 514*b* to extend, thereby forming the extended barrier column. The latch member 516 may be operated by either of the trigger mechanisms of the embodiments 300 or 400 illustrated in FIGS. 3 and 4.

Figure 6:
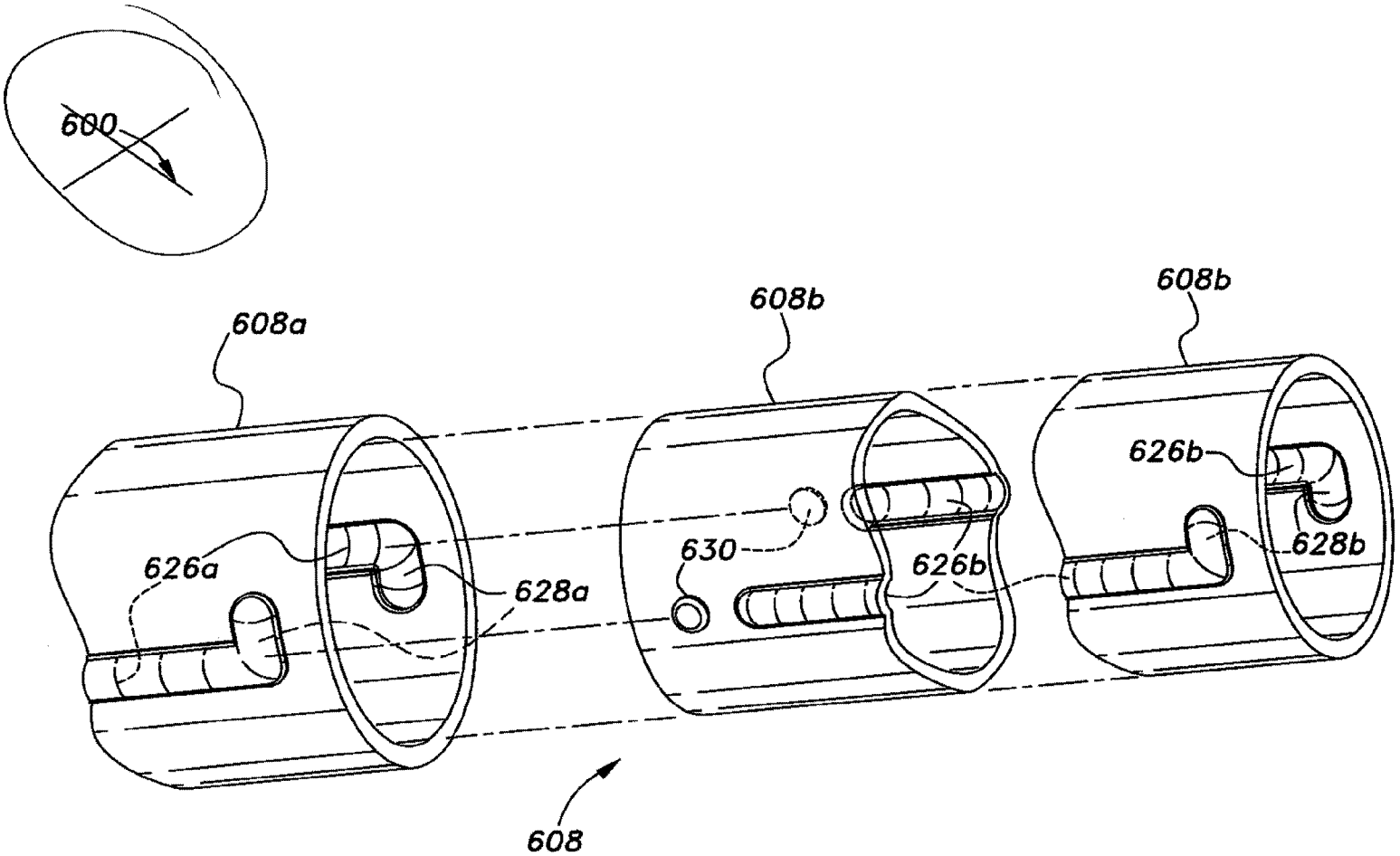
FIG. 6 is a broken away detailed perspective view of a fifth embodiment of the portable expanding barrier for Muslim worshippers according to the present invention, illustrating an alternative means of locking the barrier in an extended state.

FIG. 6 is a broken away detailed perspective view of another alternative embodiment of the expanding barrier column, designated as column 608. The column 608 is formed of multiple sections or segments of rigid hollow pipe or tube components, e.g., sections 608*a* and 608*b* as shown in FIG. 6. Section or portion 608*b* has an outside diameter equal to or slightly less than the inside diameter of the first section or portion 608*a*, in order that section 608*b* can telescope concentrically into the first section 608*a*. Each section of tube 608*a* and 608*b* includes a pair of longitudinal internal grooves, respectively 626*a* and 626*b*, with the grooves terminating in short semicircumferential segments, respectively 628*a* and 628*b*. Each section also has a pair of protruding pins, e.g., the pins 630 of the second tubular section 608*b*. The pins 630 of each section, e.g., section 608*b*, slide within the mating grooves, e.g., grooves 626*a*, of the adjoining tubular section. When the various sections are extended to the maximum permitted by the pins 630 reaching the ends of their respective grooves, the adjoining inner section, e.g., section 608*b*, is rotated slightly relative to the adjoining outer section, e.g., section 608*a*, to position the pins 630 in the corresponding semicircumferential groove segments 628*a*. This locks the segments 608*a*, 608*b* in their fully extended state. It will be seen that the same process may be continued through a series of additional tubular segments (not shown) to provide an extended barrier column 608 of any practicable length as desired.

Figure 7:
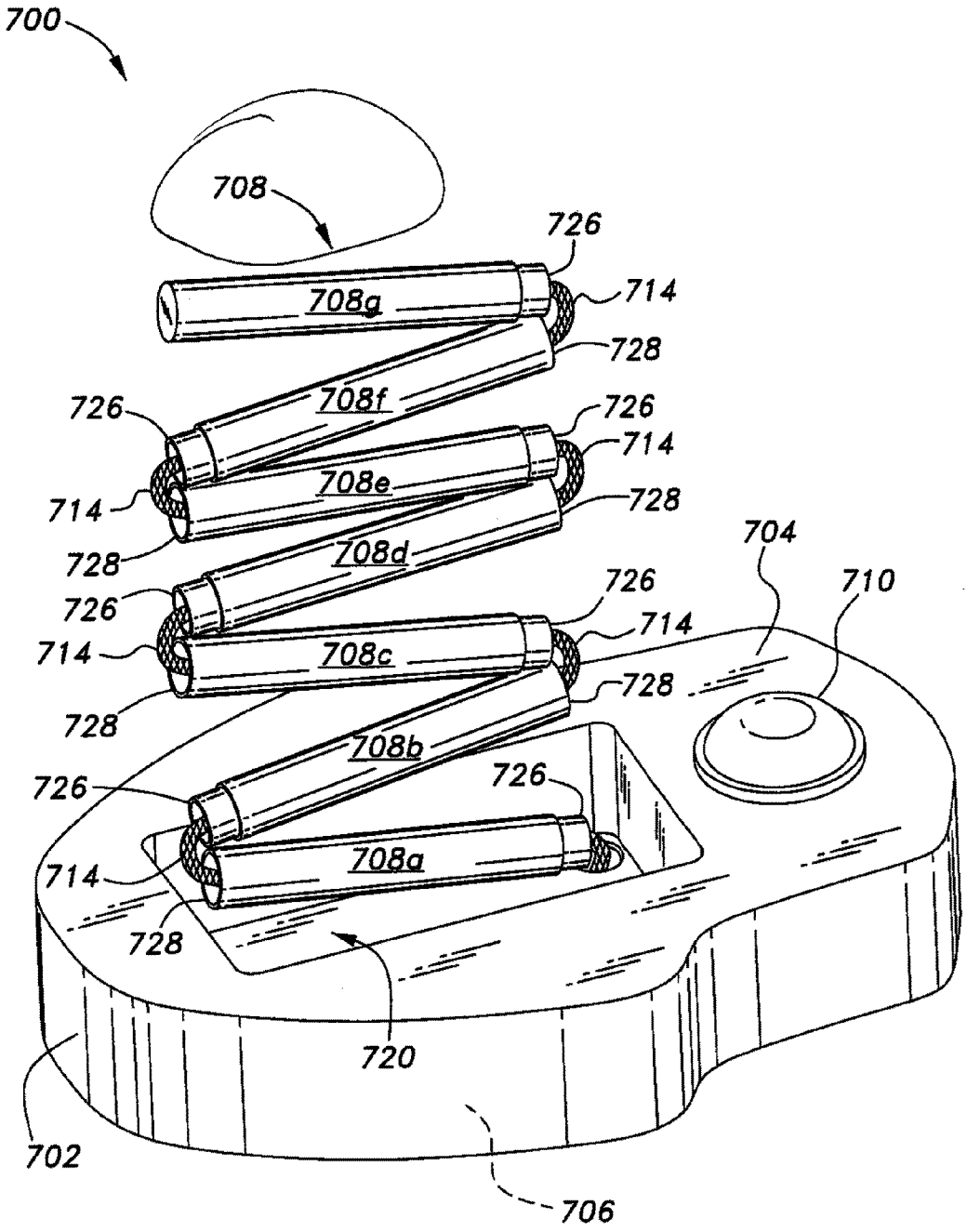
FIG. 7 is an environmental, perspective view of a sixth embodiment of the portable expanding barrier for Muslim worshippers according to the present invention, illustrating the device in a partially extended state.

FIG. 7 is a perspective view of yet another embodiment of the portable expandable barrier, designated as barrier 700. The barrier 700 includes a base 702 having an upper surface 704 and an opposite lower surface 706, similar to corresponding components of other embodiments. A compass 710 is provided in the upper surface 704 of the base 702. However, the barrier column 708 of the barrier embodiment 700 differs from the barrier columns of other embodiments, comprising a plurality of hollow tubular segments, e.g., segments 708*a* through 708*g* (more or fewer segments may be provided). Each segment has a smaller diameter lower end 726 that fits closely within the larger diameter upper end 728 of the adjacent tubular segment, e.g., the lower end 726 of the second tubular segment 708*b* fits within the upper end 728 of the next lower adjoining tubular segment 708*a*, etc. The smaller diameter lower end 726 of the lowermost tubular segment 708*a* seats within a receptacle in the base 702 when the barrier column 708 is erected. Rather than requiring the user to assemble each of the tubular segments with one another, a continuous tensile member 714 (e.g., bungee cord, tension spring, etc.) is installed through the hollow cores of all of the various tubular segments 708*a* through 708*g*. When the various tubular segments 708*a* through 708*g* are aligned coaxially with one another, the tensile member 714 draws the smaller ends 726 of each segment into the larger end 728 of the adjoining segment to lock the segments together, thereby forming the completed and erected barrier column. The column may be broken down for storage by withdrawing the smaller ends of each segment from the larger end of the adjoining segment, and folding the segments generally as shown in FIG. 7. A barrier storage receptacle 720 is provided in the base 702 for the storage of the tubular segments 708*a* through 708*g*.

Figure 8:
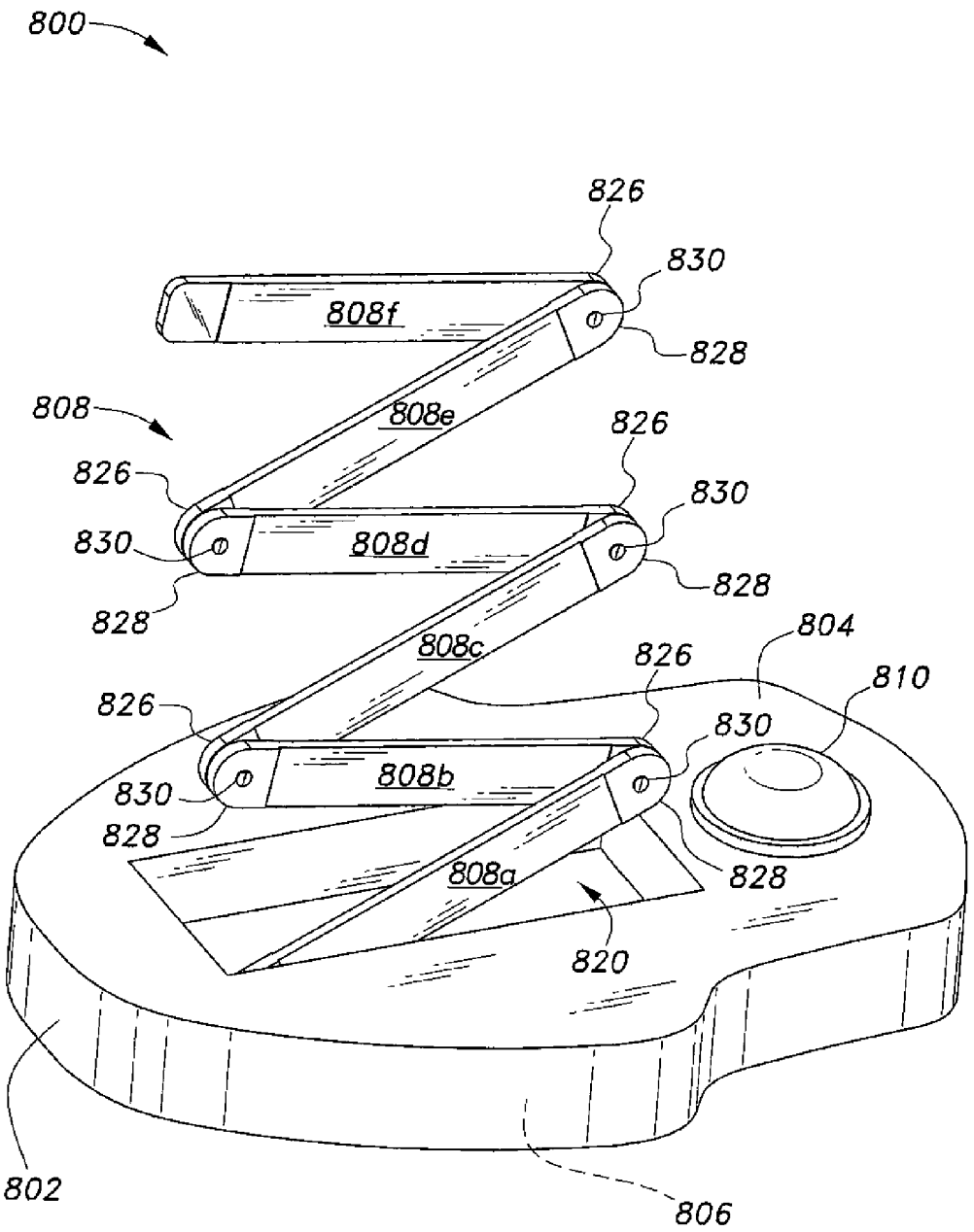
FIG. 8 is an environmental, perspective view of a seventh embodiment of the portable expanding barrier for Muslim worshippers according to the present invention, illustrating the device in a partially extended state.

FIG. 8 is a perspective view of a further embodiment of the portable expandable barrier, designated as barrier 800. The barrier 800 includes a base 802 having an upper surface 804 and an opposite lower surface 806, similar to corresponding components of other embodiments. A compass 810 is provided in the upper surface 804 of the base 802. However, the barrier column 808 of the barrier embodiment 800 differs from the barrier columns of other embodiments, comprising a plurality of rigid flat segments, e.g., segments 808*a* through 808*f* (more or fewer segments may be provided). Each segment has a first end 826, i.e., the lower end of the segment when the barrier column 808 is erected, and an opposite second end 828 that comprises the upper end of the segment when the column 808 is erected. Each first or lower end 826 is secured to a second or upper end 828 of an adjoining segment by a pivot 830, with the exception of the lower end of the first segment 808*a*, which is pivotally secured within the barrier storage receptacle 820. The various segments 808*a* through 808*f* fold parallel to one another for storage, in the manner of a folding yardstick or the like. The joints formed by the adjoining ends 826, 828 and their pivots 830 preferably include sufficient friction, or a decent, etc., for the segments 808*a* through 808*f* to remain aligned with one another in an orientation substantially normal to the plane of the base 802 when the barrier column 808 is erected. The frictional resistance between adjoining segments may be overcome for folding the segments together for storage within the storage receptacle 820 provided in the base 802.

It is to be understood that the present invention is not limited to the embodiments described above, but encompasses any and all embodiments within the scope of the following claims.

I claim:

1. A portable expanding barrier for Muslim worshippers, comprising:

a base having an upper surface and a lower surface; a single barrier column disposed for selectively extending upwardly from upper surface of the base, and selectively retracting into the upper surface of the base;

a barrier extension mechanism disposed in the base, the barrier extension mechanism including:

a spring disposed in a compressed position;

a lock for maintaining the spring in the compressed position; and a trigger disposed in the lower surface of the base, the trigger selectively releasing the lock, thereby releasing the spring from the compressed position;

wherein the trigger automatically releases the lock when the base is placed upon a supporting surface; and a directional indicator disposed in the upper surface of the base.

2. The portable expanding barrier for Muslim worshippers according to claim 1, further comprising a prayer rug permanently attached to the lower surface of the base, the prayer rug extending from the base.

3. The portable expanding barrier for Muslim worshippers according to claim 1, wherein the barrier column comprises a plurality of mutually telescoping tubular segments.

4. The portable expanding barrier for Muslim worshippers according to claim 1, wherein the barrier column further comprises a flexible sleeve, wherein the spring is encased in the flexible sleeve.

5. A portable expanding barrier for Muslim worshippers, comprising:

a base having an upper surface and a lower surface;

a directional indicator disposed in the upper surface of the base;

a single barrier column selectively extending from and retracting into the upper surface of the base;

an automatic barrier extension mechanism for selectively extending and retracting single barrier column;

an actuation trigger disposed on the lower surface of the base, the actuation trigger actuating the automatic barrier extension mechanism;

wherein the automatic barrier extension mechanism selectively extends the single barrier column upon placing the base on a supporting surface, and the actuation trigger engages the supporting surface; and a prayer rug permanently attached to the lower surface of the base, the prayer rug extending from the base.

6. The portable expanding barrier for Muslim worshippers according to claim 5, wherein the automatic barrier extension mechanism includes a compression spring disposed in the base.

7. The portable expanding barrier for Muslim worshippers according to claim 5, wherein the barrier column comprises a plurality of mutually telescoping tubular segments.

8. The portable expanding barrier for Muslim worshippers according to claim 6, wherein the compression spring is encased in a flexible sleeve.

9. A portable expanding barrier for Muslim worshippers, comprising:

a base having an upper surface and a lower surface;

a barrier column selectively disposed upon the upper surface of the base; and a barrier extension mechanism for vertically supporting the barrier column in the upper surface of the base, the barrier extension mechanism including:

a spring disposed in a compressed position;

a lock for maintaining the spring in the compressed position; and a trigger disposed in the lower surface of the base, the trigger selectively releasing the lock, thereby releasing the spring from the compressed position;

wherein the trigger automatically releases the lock when the base is placed upon a supporting surface; and a directional indicator disposed in the upper surface of the base, wherein the directional indicator is adjacent to the barrier extension mechanism.

10. The portable expanding barrier for Muslim worshippers according to claim 9, further comprising a prayer rug permanently attached to the lower surface of the base, the prayer rug extending from the base.

11. The portable expanding barrier for Muslim worshippers according to claim 9, wherein the barrier column comprises a plurality of telescoping tubular segments;

wherein the plurality of telescoping tubular segments are coaxially nested in a retracted state, and coaxially aligned and vertically fixed in an extended state.

* * * * *